US005971064A

United States Patent [19]

Palm

[11] Patent Number: 5,971,064

[45] Date of Patent: Oct. 26, 1999

[54] SHELL-AND-TUBE HEAT EXCHANGERS

[75] Inventor: Bengt Palm, Genarp, Sweden

[73] Assignee: Tetra Laval Holdings & Finance S.A., Pully, Switzerland

[21] Appl. No.: 09/077,807

[22] PCT Filed: Dec. 12, 1996

[86] PCT No.: PCT/SE96/01667

§ 371 Date: Sep. 10, 1998

§ 102(e) Date: Sep. 10, 1998

[87] PCT Pub. No.: WO97/21970

PCT Pub. Date: Jun. 19, 1997

[30] Foreign Application Priority Data

Dec. 14, 1995 [DK] Denmark ..... 1416/95

[51] Int. Cl.[6] ..... F28F 9/02

[52] U.S. Cl. ..... 165/158; 165/174; 165/DIG. 427

[58] Field of Search ..... 165/134.1, 158, 165/174, DIG. 428

[56] References Cited

U.S. PATENT DOCUMENTS

| | | | |
|---|---|---|---|
| 686,996 | 11/1901 | Webster | 165/174 X |
| 2,655,437 | 10/1953 | Garbo | 165/174 |
| 2,780,446 | 2/1957 | Huet . | |
| 4,495,987 | 1/1985 | Finnan | 165/70 |
| 4,785,877 | 11/1988 | Shen-Tu | 165/134.1 |
| 5,586,599 | 12/1996 | Sjöström . | |

FOREIGN PATENT DOCUMENTS

| | | | |
|---|---|---|---|
| 608310 | 9/1960 | Italy | 165/174 |
| 135 429 | 4/1952 | Sweden . | |
| 138 362 | 12/1952 | Sweden . | |
| 635793 | 4/1950 | United Kingdom | 165/174 |

*Primary Examiner*—Allen Flanigan
*Attorney, Agent, or Firm*—Burns, Doane, Swecker & Mathias, L.L.P.

[57] ABSTRACT

The disclosure relates to an improvement in a shell-and-tube heat exchanger particularly intended for products containing fibres (11) or particles.

The improvement comprises a product flow insert (5) consisting of a number of heat transfer tubes (3) with a baffle plate (6) fixedly secured in each end (13) of these transfer tubes (3). En order for fibres (11) and particles to pass the baffle plates (6) without undesirably accumulating, at least that one of the baffle plates (6) which is turned to face towards the direction of flow of the product is designed with flow distributors (12) which wholly or partly surround the tube ends (13) of the heat transfer tubes (3).

7 Claims, 6 Drawing Sheets

SHELL-AND-TUBE HEAT EXCHANGERS

TECHNICAL FIELD

The present invention relates to an improvement to a shell-and-tube heat exchanger, including a product flow insert consisting of a number of heat transfer tubes with a baffle plate disposed in each end of the heat transfer tubes.

BACKGROUND ART

Heat exchangers, of which there are a plurality of types, are employed to heat or cool a liquid product. Using, for example, water vapour or water at different temperatures, it is possible to heat or cool to the desired level a product which is preferably in liquid form. Heat exchangers come into use in various process industries and are also common phenomena in food industries such as dairies and juice factories.

One well-known type of heat exchanger is the so-called shell-and-tube heat exchanger which consists of one or more heat exchanger elements which are interconnected together to form a flow system. The heat exchanger elements consist of one or more heat transfer tubes surrounded by an outer shell or jacket tube. The heat transfer tubes are interconnected with one another to form product flow inserts which in turn are interconnected by means of product pipe bends in order to circulate the product which is to be heated or cooled, depending upon the process for which the heat exchanger is employed. The heat exchanger tubes are enclosed in shell or jacket tubes which also enclose the heat transfer medium which may consist of water at different temperatures, water vapour or other types of liquids or gases. One type of shell-and-tube heat exchanger is described in Swedish Patent Specification SE 501908.

A shell-and-tube heat exchanger in accordance with the foregoing description may be employed for treating liquids containing large particles or fibres, such as, for example, orange juice with relatively long fibres. Uncut orange fibres may be as much as 25 mm in length. When the fibrous liquid is caused to pass through the product flow inserts, the liquid from the product pipe bends must be distributed via a baffle plate into the individual heat transfer tubes. In such instance, it is a common occurrence that the fibres "hang" on the edge, at the entry to the heat transfer tubes and accumulate here. Trials have shown that, when the pressure increases in such an event, a complete accumulation of fibres is often flushed out after a while, whereafter the accumulation begins again and this results in an uneven distribution of the fibres in the liquid. Extreme accumulations of fibres may also give rise to productional disruptions and problems involved in cleaning. Large particles may also contribute in forming plugs in the inlets to the individual heat transfer tubes.

One method of obviating these problems is to increase the diameter of the heat transfer tubes so that the fibres and particles may more easily gain access. An extreme solution of this method is the monotube which, however, gives rise to poor heat transfer coefficient, long tubes and long process times. It is therefore desirable to keep the diameter of the heat transfer tubes as small as possible, for large particles heat transfer tubes in conventional shell-and-tube heat exchangers must be selected with an inner diameter which is between 2 and 2.5 times larger than the particles which are to pass through these tubes, which thus reduces the heat transfer coefficient.

OBJECT OF THE INVENTION

One object of the present invention is to design the tube baffles so that the fibres are not accumulated but so that a production is obtained without the risk of disruption and with a uniform fibre or particle distribution in the liquid and without intermittent pressure changes in the product.

SOLUTION

This and other objects have been attained according to the present invention in that the improvement of the type disclosed by way of introduction has been given the characterizing feature that at least one of the baffle plates is designed with flow distributors wholly or partly surrounding the tubes ends.

Preferred embodiments of the present invention have further been given the characterizing features as set forth in the appended subclaims.

BRIEF DESCRIPTION OF THE ACCOMPANYING DRAWINGS

The preferred embodiments of the present invention will now be described in greater detail hereinbelow, with particular reference to the accompanying Drawings, in which.

DESCRIPTION OF PREFERRED EMBODIMENTS

Figure 1:
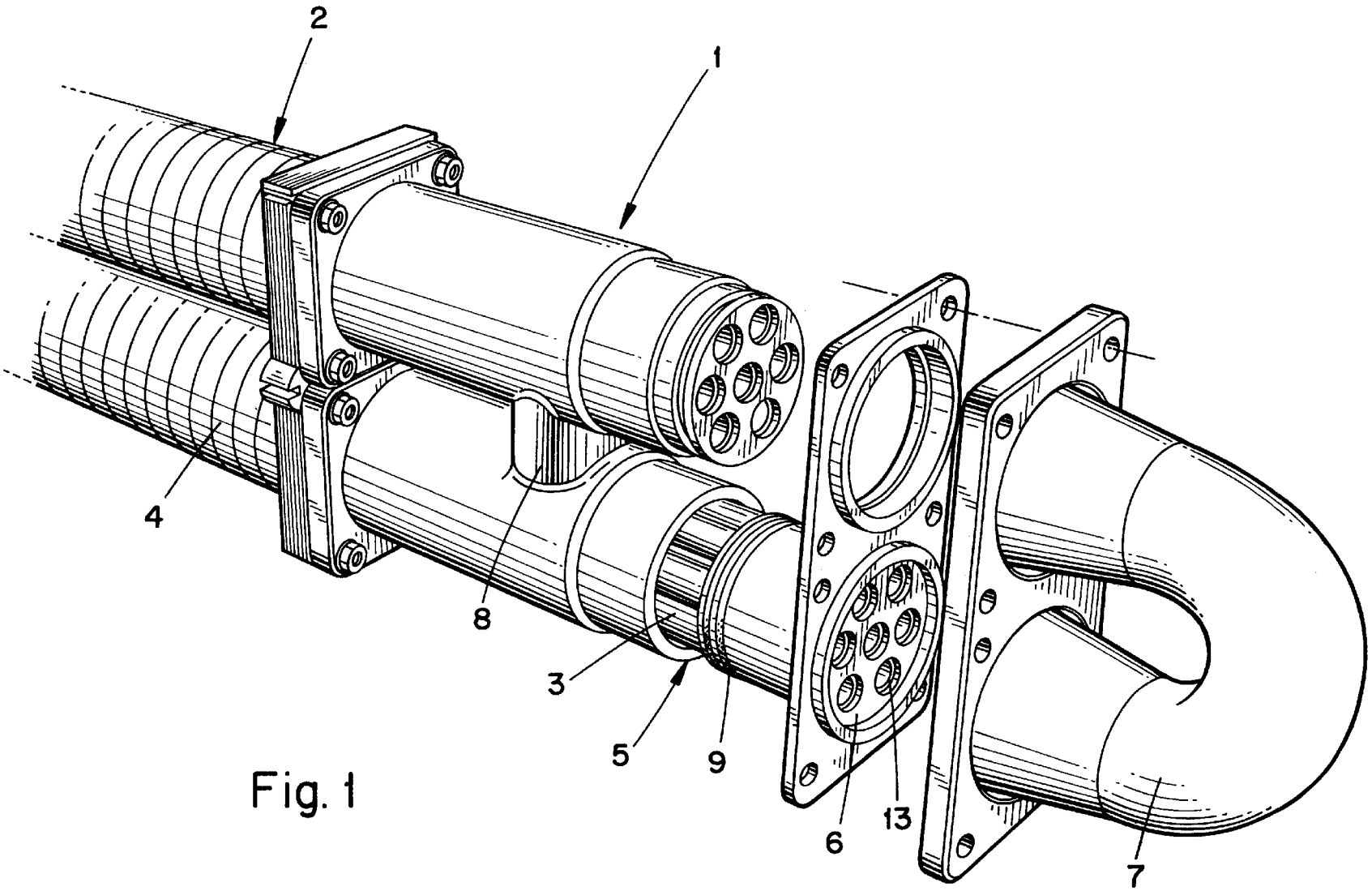
FIG. 1 shows the principle of a shell-and-tube heat exchanger.

FIG. 1 shows the principle of a shell-and-tube heat exchanger 1 in which one (or most generally several) heat exchanger elements 2 are interconnected to form a flow unit. Each heat exchanger element 2 consists of a number of heat transfer tubes 3 surrounded by an outer shell or jacket tube 4. The heat transfer tubes 3 in each shell or jacket tube 4 are united to form a product insert 5 by a tube or baffle plate 6 being disposed at each end 13 of the heat transfer tubes 3. The product inserts 5 with their heat transfer tubes 3 are intended to circulate the product which is to be treated in the heat exchanger 1. The various product inserts 5 are interconnected to one another by means of product pipe bends 7, and the outer product inserts 5 are connected to inlet and outlet conduits, respectively, for the product. The intention is to gather as large a number of heat transfer tubes 3 as it is possible to enclose in the shell or jacket tube 4, taking into account the product that is to be circulated. A product containing particles or fibres 11 requires a tube diameter of the heat transfer tubes which is between 2 and 2.5 times the size of the particles in the product. The greater the number and the smaller the size of the heat transfer tubes 3 that may be accommodated in the shell or jacket tube 4, the more efficient will be the heat transfer obtained.

In the shell or jacket tube 4 surrounding the product inserts 5, the heat transfer medium which is to be employed is enclosed, i.e. water or other liquid at various temperatures, or alternatively water vapour or other gas. The shell or jacket tubes 4 are in their turn interconnected with communicating angle pipe sections 8, or alternatively with inlet or outlet connections for the heat transfer medium. The product inserts 5 are fitted in the shell or jacket tube 4 with gaskets 9 so that product and heat transfer medium are kept discrete from one another.

Figure 3:
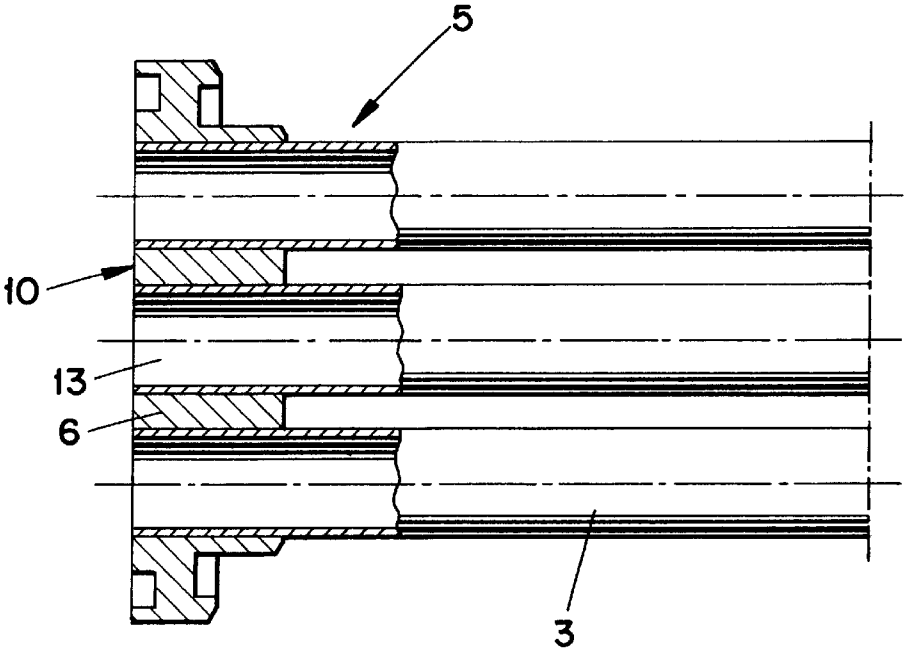
FIG. 3 shows heat transfer tubes connected to a baffle plate according to a prior art solution.
Figure 2:
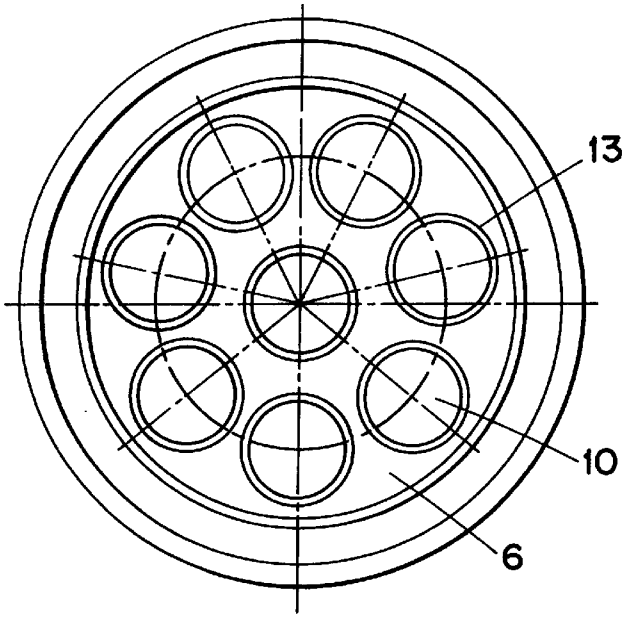
FIG. 2 shows a baffle plate according to a prior art solution.

When the product reaches a product insert 5, either via a product pipe bend 7 or an inlet conduit, the product at the baffle plate 6 must be distributed into the different heat transfer tubes 3. The ends 13 of the heat transfer tubes 3 are secured in the baffle plate 6 and this has, in accordance with prior art solutions, displayed an almost planar surface 10 to the product pipe bend 7 and the product flow (see FIGS. 2 and 3).

For products with particles and elongate fibres 11, such as, for example, orange juice, it has proved that this prior art solution gives rise to the accumulation of fibres 11 on the edge to the inlets to the heat transfer tubes 3, since the fibres 11 have not had the possibility to become oriented and distributed before reaching the baffle plate 6 and the heat transfer tubes 3, but get "hung" between the heat transfer tubes 3.

The aim of the present invention is to permit the fibres 11 in the product to become oriented when they reach the baffle plate 6, such that the fibres 11 accompany the product liquid without becoming "hung" and accumulating on the baffle plate 6. This has been achieved in that the baffle plate 6 has been provided with flow distributors 12. These flow distributors 12 wholly or partly surround the tube ends 13 of the heat transfer tubes 3 on the baffle plate 6. FIGS. 4–11 show different embodiments of the invention.

Figure 12:
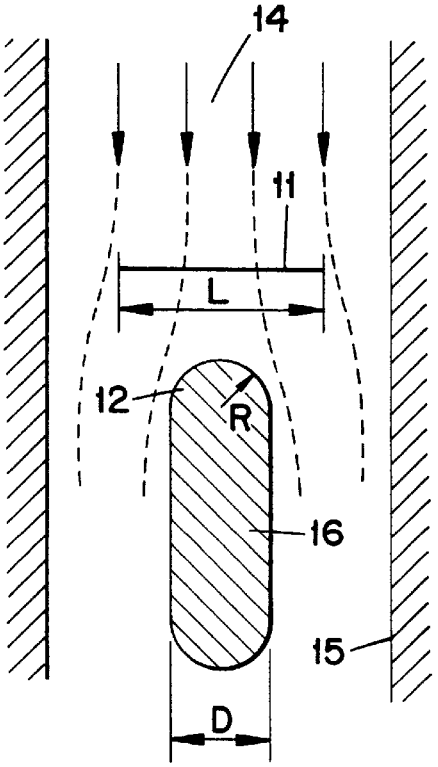
FIG. 12 shows the principle of a flow distributor.

The principle of a flow distributor according to the invention is shown in FIG. 12. A liquid flow 14 with fibres 11 of a certain maximum length L is enclosed in a duct or a tube 15. At a throttle 16 in the duct or tube 15, the liquid distributes slightly upstream of the throttle 16 so that the fibres 11 may pass through the throttle either on one side or the other. However, if the throttle 16 has straight edges and is relatively narrow towards the flow direction, the fibres 11 risk becoming "hung" over the throttle 16. By designing the throttle 16 with a flow distributor 12 in that end of the throttle 16 which faces towards the flow 14, the possibility will be obtained of orienting and distributing the fibres 11 before they reach the throttle 16. The flow distributor 12 should be of gently, non-impeding configuration and, in the preferred embodiments, consists of a semi circle. The radius R of the flow distributor 12, which is equal to half of the diameter D of the throttle 16, should be selected such that R constitutes at least a fourth of the maximum fibre length L. Trials have shown that, using this dimensional distribution, the fibres 11 may be caused to distribute and become oriented such that they pass the throttle 16 without fastening to it.

Figure 5:
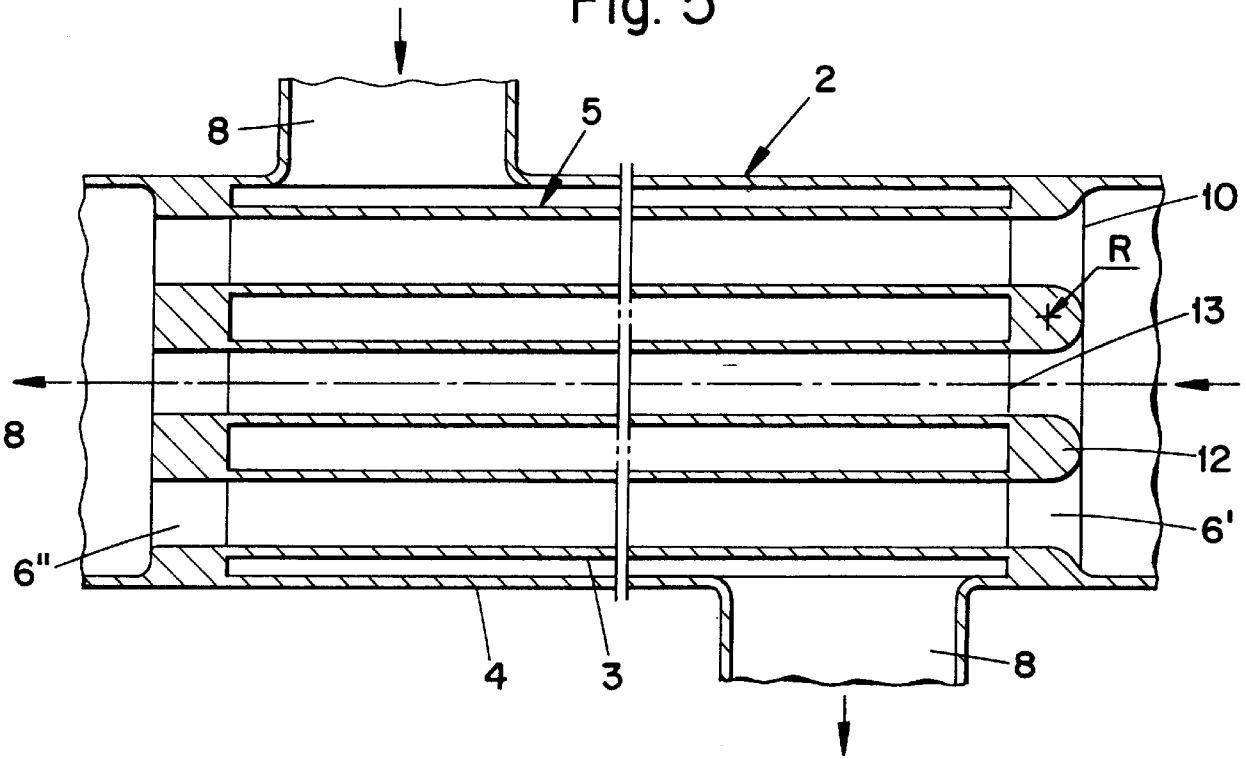
FIG. 5 is a side elevation of the embodiment of FIG. 4, partly in section.
Figure 4:
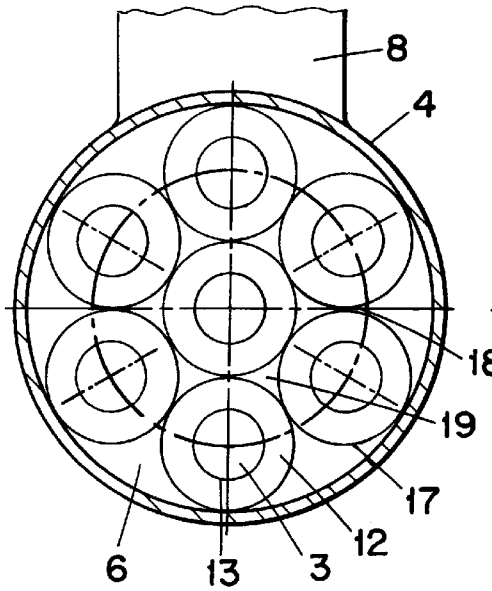
FIG. 4 shows a first embodiment of the present invention.

By employing this flow principle on a baffle plate 6 according to the present invention, the radius R of the flow distributor 12 is selected such that products with long fibres 11 may pass. For example, orange juice with uncut fibres 11 may have a fibre length L of up to 25 mm, for which reason the radius R of the flow distributor 12 should, in this example, be 6.5–7 mm in the first preferred embodiment of the present invention which is shown in FIGS. 4 and 5, the one baffle plate 6' of the product insert 5 is provided with flow distributors 12 according to the invention. This baffle plate 6' on the product insert 5 must therefore be turned to face towards the flow direction of the product, as illustrated in FIG. 5. This baffle plate 6' is designed with flow distributors 12 surrounding the ends 13 of the heat transfer tubes 3. The flow distributors 12 wholly and symmetrically surround the tube ends 13 so that the surface 10 of the baffle plate 6' will have the appearance of gentle funnels at the entry to the heat transfer tubes 3. The baffle plate 6" placed in the other end of the product insert 5 displays a completely planar surface 10.

The flow distributors 12 are shown in the Drawings as rings 17. Where the rings 17 are tangential to one another, a point 18 will be created which constitutes a part of the upper surface 10 of the baffle plate 6. The space 19 between three rings 17 has the same height as the point 18 and thus also constitutes a part of the surface 10.

Figure 7:
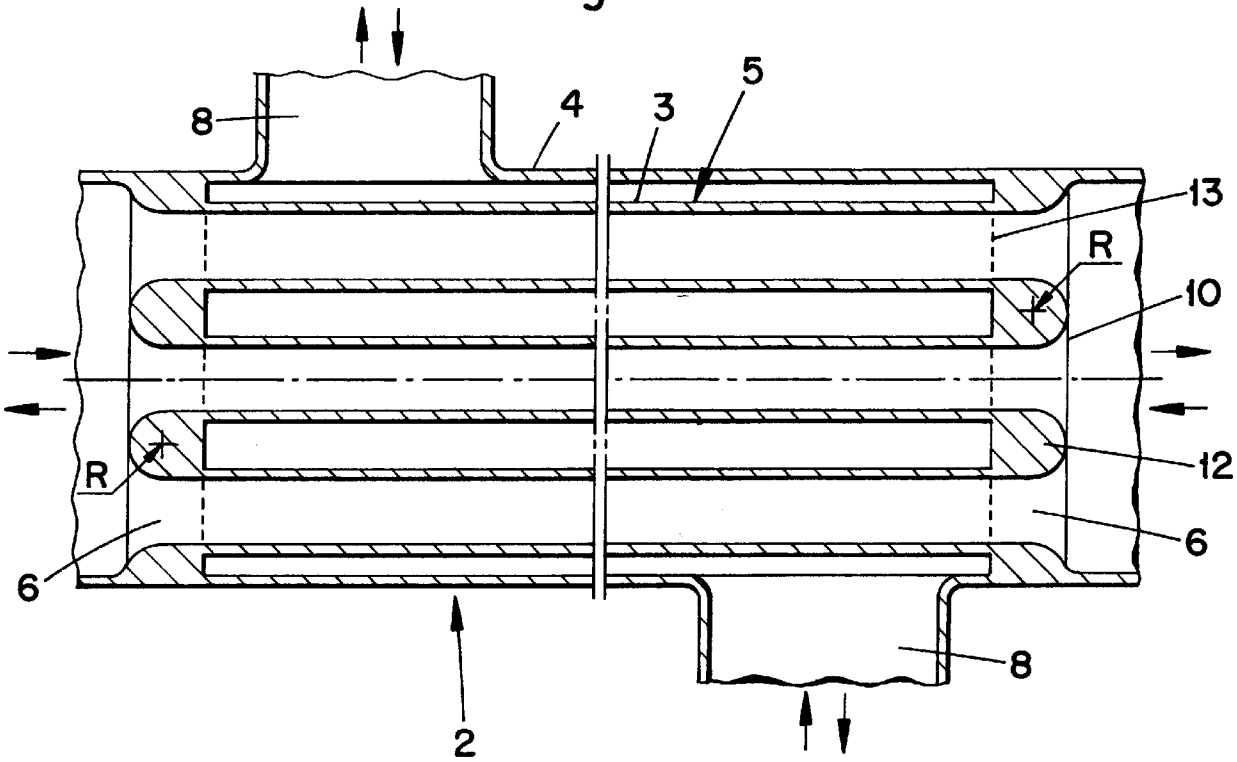
FIG. 7 is a side elevation of the embodiment of FIG. 6, partly in section.
Figure 6:
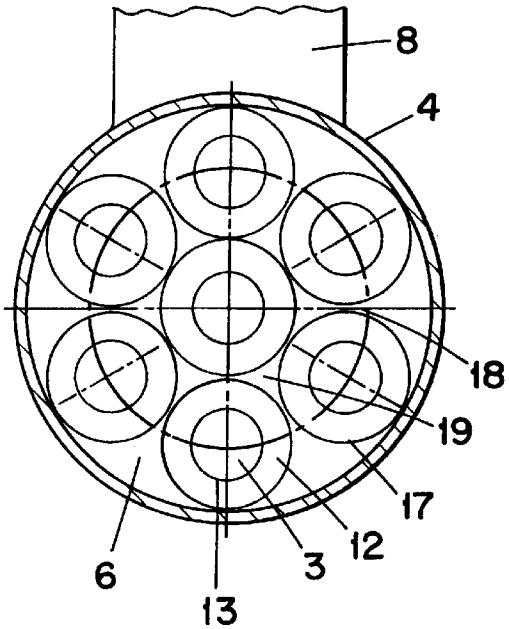
FIG. 6 shows a second embodiment of the present invention.

The second preferred embodiment of the present invention is shown in FIGS. 6 and 7. In this embodiment, both of the baffle plates 6 on the product insert 5 are provided with flow distributors 12 which wholly and symmetrically surround the tube ends 13 of the heat transfer tubes 3. This embodiment of the present invention is to be preferred when, in large scale shell-and-tube heat exchangers 1, it is often desired to switch the flow during the production cycle without consequently needing to dismantle the shell-and-tube heat exchanger 1 in order to adapt the correct plate 6' to the flow direction of the product.

However, the flow distributors 12 in the first and second embodiments of the present invention take up a relatively large space on the baffle plate 6 since they are wholly and symmetrically to surround the ends 13 of the heat transfer tubes 3. As a result of this contributory factor, the number of heat transfer tubes 3 which can be accommodated in each respective shell or jacket tube 4 will be fewer than in a planar baffle plate 6.

Figure 9:
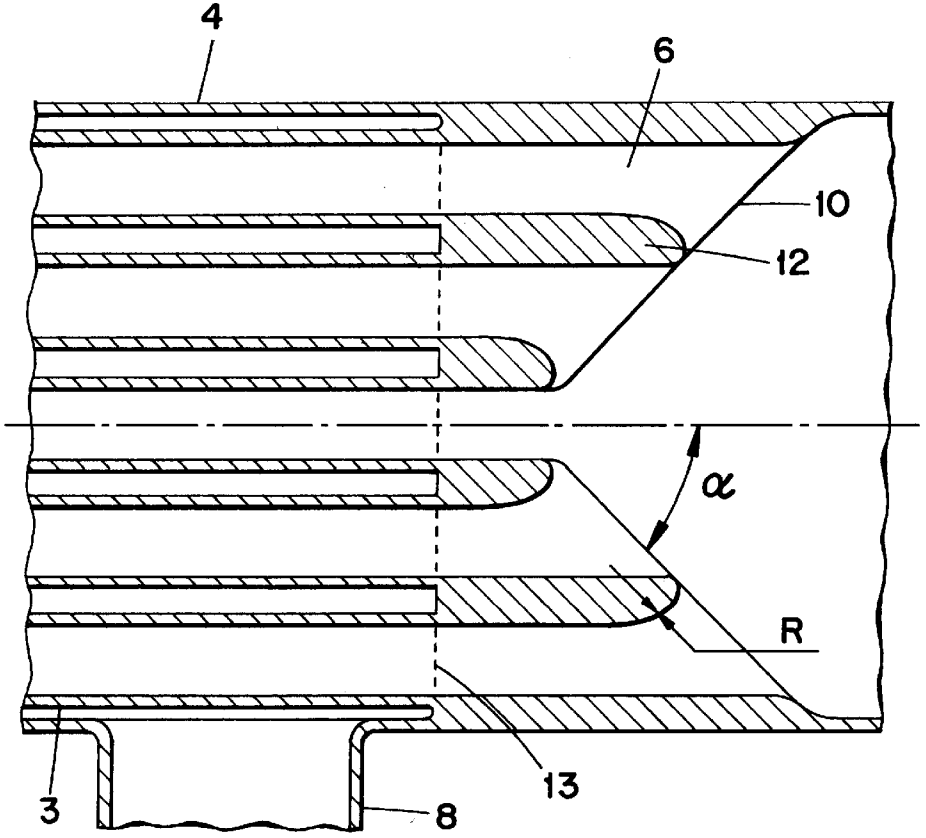
FIG. 9 is a side elevation of the embodiment of FIG. 8, partly in section.
Figure 8:
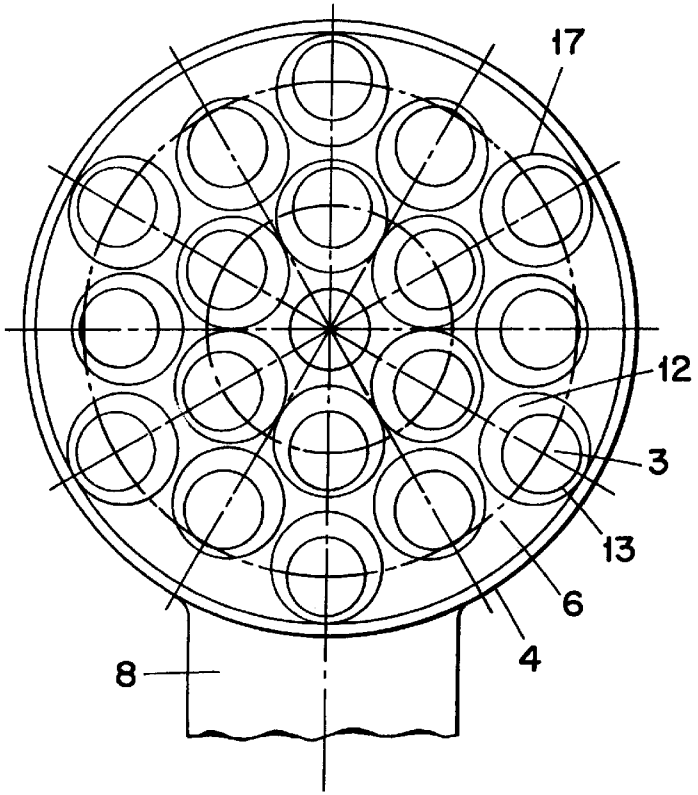
FIG. 8 shows a third embodiment of the present invention.

FIGS. 8 and 9 show a third embodiment of the present invention in which a larger number of heat transfer tubes 3 may be accommodated on each baffle plate 6. The flow distributors 12 have here been placed asymmetrically in relation to the tube ends 13 of the heat transfer tubes 3 so that they only partly surround the tube ends 13. In order to compensate for the fact that the flow distributors 12 do not wholly surround the tube ends 13, the baffle plate 6 has, at the same time, been angled in towards the centre of the plate 6. The surface 10 of the baffle plate 6 will thus be funnel shaped. The baffle plate 6 is angled at an angle $\alpha$ which is 45–75°, preferably 45–60°. Thus, the baffle plate 6 will require a slightly larger space than in the two preceding embodiments of the present invention.

Figure 10:
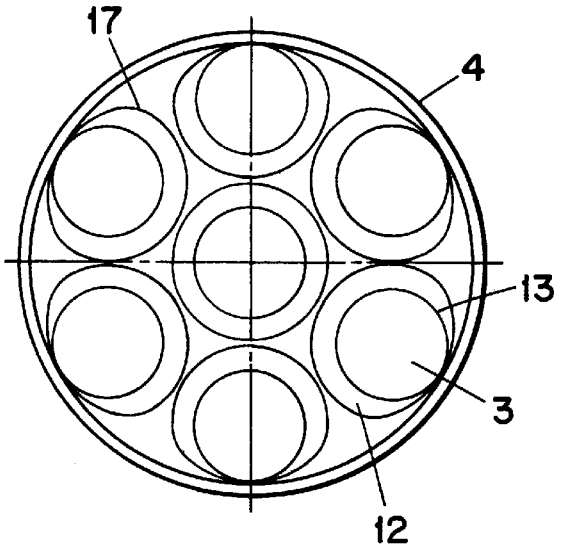
FIG. 10 shows a fourth embodiment of the present invention.
Figure 11:
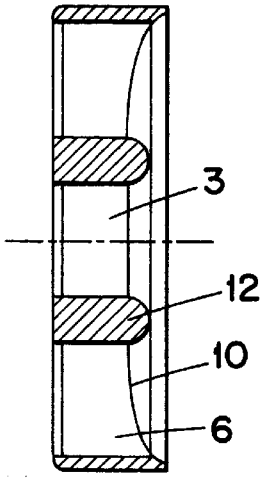
FIG. 11 is a side elevation of the embodiment of FIG. 10, partly in section.

The fourth embodiment, as illustrated in FIGS. 10 and 11, has a baffle plate 6 with a slightly cupped surface 10 and with flow distributors 12 which only partly surround the tube ends 13 of the heat transfer tubes 3. With this embodiment, there is room for a larger number of heat transfer tubes 3, at the same time as the cup-shaped surface 10 compensates for the fact that the flow distributors 12 only partly surround the tube ends 13 of the heat transfer tubes 3. The cupped shaped surface 10 also makes it possible for the baffle plate 6 to be shorter than is the case in the third embodiment of the present invention.

On employment of the improvement according to the present invention for a shell-and-tube heat exchanger 1 in which the intention is to process a product containing particles or fibres 11, the fibrous product will thus be circulated in a number of product inserts 5 which are mutually interconnected by means of product pipe bends 7. That heat transfer medium which is employed is simultaneously circulated against this product flow, enclosed in the shell or jacket tubes 4 and surrounding the heat transfer tubes 3. At least in one end, each product insert 5 is provided with the improvement according to the present invention which should then be oriented in the inlet end of the product flow direction. The product then meets a surface 10 on the baffle plate 6 with gently rounded inlets to the heat transfer tubes 3, so that particles and fibres 11 readily accompany the liquid product into the heat transfer tubes 3.

As will have been apparent from the foregoing description, the improvement according to the present invention provides a possibility of employing a shell-and-tube heat exchanger 1 with heat transfer tubes 3 of relatively small diameters, for products which contain particles or long fibres 11. The present invention permits the fibres 11 to be guided gently and efficiently into the heat transfer tubes 3 without the fibres 11 running the risk of becoming accumulated on the surface 10 of the baffle plate 6.

The present invention should not be considered as restricted to that described above and shown on the Drawings, many modifications being conceivable without departing from the spirit and scope of the appended claims.

What is claimed is:

1. A shell-and-tube heat exchanger comprising:

a product flow insert comprising a plurality of heat transfer tubes for product, each tube having two ends;

a baffle plate disposed in each end of said heat transfer tubes, at least one of said baffle plates including flow distributors at least partly surrounding said tube ends and including portions disposed between adjacent tube ends which are convex in cross-section and asymmetrically contoured; and wherein said at least one of said baffle plates has a concave inwardly angled surface.

2. The heat exchanger as claimed in claim 1, wherein said flow distributors surround said tube ends of the heat transfer tubes wholly and symmetrically.

3. The heat exchanger as claimed in claim 1, wherein said flow distributors only partly surround said tube ends of the heat transfer tubes.

4. The heat exchanger as claimed in claim 3, wherein said at least one baffle plate includes a surface which is angled at an angle $\alpha$ towards the centre of the baffle plate.

5. The heat exchanger as claimed in claim 4, wherein said angle $\alpha$ is 45–60°.

6. The heat exchanger as claimed in claim 3, wherein said at least one baffle plate includes a cup-shaped surface.

7. The heat exchanger as claimed in claim 1, further comprising:

a fluid product flowing through at least one of said baffle plates, said fluid product including particles or fibres of a maximum length (L) said flow distributors convex portions having a radius (R) at least 0.25 times said length (L).

* * * * *